US008833893B2

(12) United States Patent
Okamoto et al.

(10) Patent No.: US 8,833,893 B2
(45) Date of Patent: Sep. 16, 2014

(54) METHOD OF PRINTING AND PRINTING APPARATUS

(75) Inventors: Takayuki Okamoto, Kawasaki (JP); Masahito Yoshida, Shiki (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 13/360,563

(22) Filed: Jan. 27, 2012

(65) Prior Publication Data

US 2012/0194597 A1 Aug. 2, 2012

(30) Foreign Application Priority Data

Feb. 1, 2011 (JP) ..... 2011-020142

(51) Int. Cl.
*B41J 29/38* (2006.01)
*B41J 11/66* (2006.01)

(52) U.S. Cl.
CPC ..... *B41J 11/663* (2013.01)
USPC ..... 347/16; 347/104

(58) Field of Classification Search
USPC ..... 347/16, 101, 104, 157
See application file for complete search history.

(56) References Cited

U.S. PATENT DOCUMENTS

2011/0211900 A1 * 9/2011 Ueda et al. ..... 400/621

FOREIGN PATENT DOCUMENTS

| | | | | |
|---|---|---|---|---|
| JP | 2001-310849 A | | 11/2001 | |
| JP | 2004-345148 A | | 12/2004 | |
| JP | 2004345148 A | * | 12/2004 | ..... B41J 11/70 |
| JP | 2005-089053 A | | 4/2005 | |

* cited by examiner

*Primary Examiner* — Manish S Shah
*Assistant Examiner* — Yaovi Ameh
(74) *Attorney, Agent, or Firm* — Canon USA Inc IP Division

(57) ABSTRACT

A reference mark is formed for cutting a sheet in a region between a first image printed on the sheet being conveyed and a second image, and the sheet is cut based on the detected reference mark. The second image is printed such that the length of the region in a conveying direction in which the sheet is conveyed corresponds to the length of the first image in the direction.

15 Claims, 8 Drawing Sheets

METHOD OF PRINTING AND PRINTING APPARATUS

BACKGROUND OF THE INVENTION

1. Field of the Invention

The present invention relates to a method of printing images on a sheet and cutting the sheet by each image and a printing apparatus.

2. Description of the Related Art

Japanese Patent Laid-Open No. 2004-345148 discloses a printing apparatus that prints a plurality of images on a continuous sheet and automatically cuts the sheet into separate images. With this apparatus, cutting marks are printed onto the continuous sheet together with the images, where these cutting marks are detected with a detector and the sheet is cut into pieces with predetermined lengths in accordance with the detection timing of the cutting marks. Only the images are kept, and the sheet fragments that remain between the images are discarded.

With a known apparatus, if patterns that resemble cutting marks are included in the images, a detector may mistakenly detect the patterns as cutting marks. In particular, when multiple images of different sizes are printed on a continuous sheet, it is difficult to estimate the positions of the cutting marks, and thus, misdetection is more likely to occur. Japanese Patent Laid-Open No. 2004-345148, however, does not disclose such concept thereof or solution therefor.

SUMMARY OF THE INVENTION

An aspect of the present invention has been conceived in light of the circumstances described above. More specifically, an aspect of the present invention enables reliable detection of cutting marks provided in a region between images.

According to one aspect of the present invention, a method of printing includes printing a first image on a sheet being conveyed, forming a reference mark for cutting the sheet in a region between the first image and a second image following the first image, printing the second image on the sheet being conveyed, detecting the reference mark, and cutting the sheet based on the detected reference mark, wherein the second image is printed to set a length of the region in a conveying direction in which the sheet is conveyed in accordance with a length of the first image in the conveying direction.

According to the present invention, detection of cutting marks provided in a region between images can be performed more reliably, and sheet cutting more reliably than that in the related art can be achieved.

Further features of the present invention will become apparent from the following description of exemplary embodiments with reference to the attached drawings.

DESCRIPTION OF THE EMBODIMENTS

An inkjet printing apparatus according an exemplary embodiment will be described below. The printing apparatus according this embodiment is a high-speed line printer supporting both single-side printing and double-side printing by using a long continuous sheet, i.e., a sheet whose length in the conveying direction is larger than the length of individual printing units that are repeated (also referred to as "pages" or "unit images"). For example, the printing apparatus is suitable for printing a large number of printouts in a printing laboratory, etc. In the following description, "unit image" refers to the entire area corresponding to a printing unit (page), where the unit image may include small images, characters, blanks, and/or margins. In other words, a unit image is a single printing unit (single page) of a plurality of pages printed in sequence on a continuous sheet. A unit image may also be simply referred to as an "image." The length of a unit image depends on the size of the image to be printed. For example, the length in the conveying direction of an L-size photograph is 135 mm, and the length in the conveying direction of an A4 size image is 297 mm.

The present invention may be applied to a wide range of printing apparatuses, such as printers, multifunction printers, copiers, facsimiles, and various manufacturing devices. The printing method is not limited, and may be any method, including an inkjet method, an electrophotographic method, a thermal transfer method, a dot impact method, or a liquid development method. In addition to printing apparatuses, the present invention may also be applied to sheet processing apparatuses that carry out various types of processing, e.g., recording, processing, application, irradiation, reading, inspection, etc., on rolled sheets.

Figure 1:
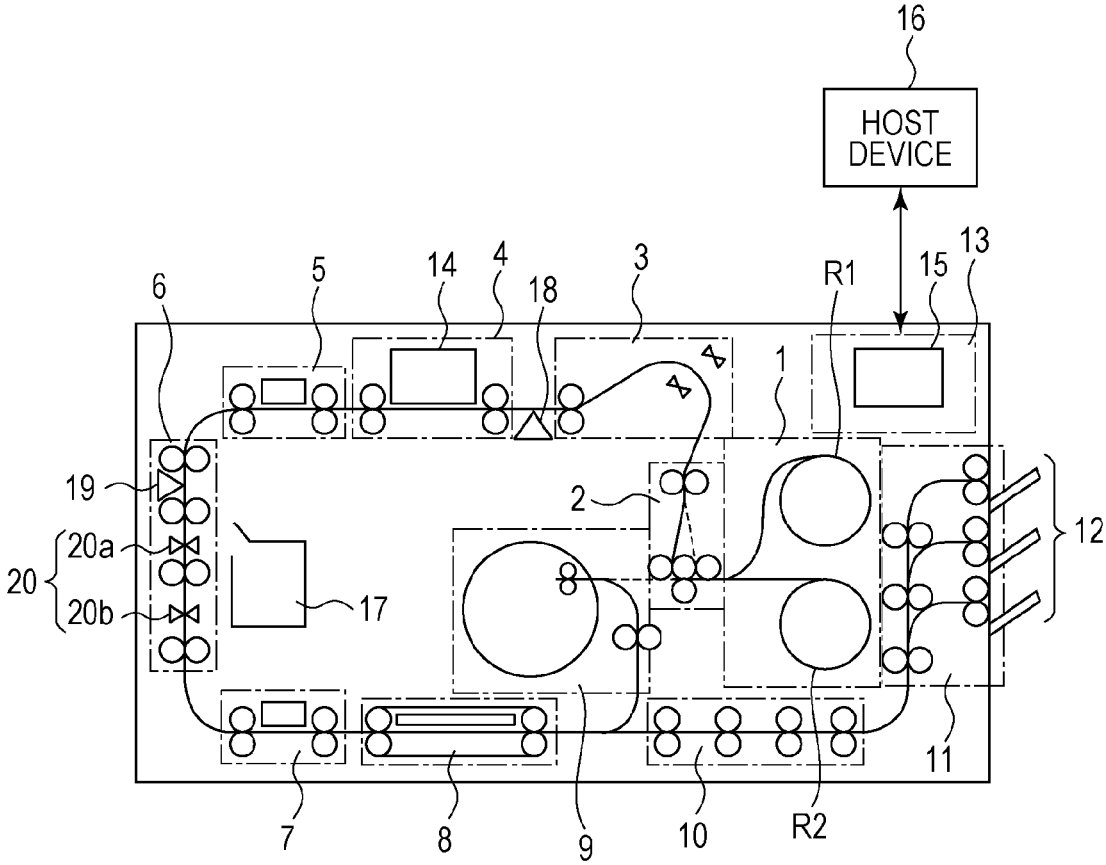
FIG. 1 is a schematic view of the internal configuration of a printing apparatus.

FIG. 1 is a schematic sectional view of the internal configuration of a printing apparatus. The printing apparatus according to the present embodiment is capable of carrying out printing on a first side of a rolled sheet and a second side of the sheet, which is the side of the sheet opposite from the first side. The printing apparatus typically includes a sheet supplying unit 1, a decurling unit 2, a skew correcting unit 3, a printing unit 4, a detecting unit 5, a cutting unit 6, an information recording unit 7, a drying unit 8, a reversing unit 9, a conveying unit 10, a sorting unit 11, an ejecting unit 12, and a control unit 13. The sheet is conveyed by a conveying mechanism, including roller pairs and belts, along a sheet conveying path indicated by solid lines in the drawing and receives processing at the various units. At any position in the sheet conveying path, from the position where the sheet is supplied to the position where the sheet is ejected, the side closer to the sheet supplying unit 1 is referred to as "upstream," and the opposite side is referred to as "downstream."

The sheet supplying unit 1 holds and supplies a roll of continuous sheet. The sheet supplying unit 1 is capable of accommodating two rolls R1 and R2 and selectively reels out a sheet from one of the rolls. The number of rolls the sheet supplying unit 1 can accommodate is not limited to two, and can be greater than two. The sheet is not limited to a roll, as long as the sheet is continuous. For example, a continuous sheet having perforations at each unit length may be folded at each perforation and stored in the sheet supplying unit 1 in a stack.

The decurling unit 2 reduces the curing (warpage) of the sheet supplied from the sheet supplying unit 1. The decurling unit 2 has one driving roller and two pinch rollers to reduce the curing of the sheet by applying a decurling force, which applies warpage in a direction opposite to the curling, while the sheet passes through a curved path.

The skew correcting unit 3 corrects the skewing (inclination with respect to the traveling direction of the sheet) of the sheet that has passed through the decurling unit 2. The skewing of the sheet is corrected by pushing the sheet edge on the reference side to a guiding member.

The printing unit 4 is a sheet processing unit that forms images by carrying out printing by a print head 14 on the sheet from the top side of the conveyed sheet. The printing unit 4 includes a plurality of conveying rollers for conveying the sheet. The print head 14 includes line print heads having inkjet nozzle arrays covering the estimated maximum width of the sheets to be used. The print head 14 includes a plurality of print heads aligned in parallel along the conveying direction. In this embodiment, seven print head corresponding to seven different colors, cyan (C), magenta (M), yellow (Y), light cyan (LC), light magenta (LM), gray (G) and black (K), are provided. The number of colors and the number of print heads are not respectively limited to seven. The inkjet method may employ heating elements, piezoelectric devices, electrostatic devices, or MEMS elements. Ink of different colors is supplied to the print head 14 from ink tanks through ink tubes.

The detecting unit 5 has a scanner for optically reading inspection patterns and images printed on the sheet at the printing unit 4, and determines whether images have been correctly printed by inspecting the nozzle condition of the print heads, the conveying condition of the sheet, the position of the images, etc. The scanner includes a charge coupled device (CCD) image sensor or a CMOS image sensor.

The cutting unit 6 includes cutters 20 for cutting the printed sheet into pieces having predetermined lengths. The cutter 20 includes first and second mechanical cutters 20*a* and 20*b*. The upstream first cutter 20*a* and the downstream second cutter 20*b* are used to efficiently cut off blacks between images formed on the sheet, as described below. The cutting unit 6 also includes a cutting-mark sensor 19 that optically detects the cutting marks printed on the sheet, a plurality of conveying rollers that feed the sheet to the next step, and an edge sensor 21 that is used to skip image detection. A trash box 17 is disposed near the cutting unit 6. The waste box 17 holds sheet fragments, which are produced by cutting off blanks with the first and second cutters 20*a* and 20*b* and discarded as waste. The cutting unit 6 has a distributing mechanism that ejects the cut-off sheet fragments to the waste box 17 or sends the cut sheets to the conveying path.

The information recording unit 7 prints printing information (unique information), such as serial numbers and/or dates, in non-printing regions of the cut sheets. The printing information is printed as characters and/or codes using an inkjet method or a thermal transfer method.

The drying unit 8 heats the sheet on which printing has been carried out at the printing unit 4 to quickly dry the applied ink. Hot air is applied to at least the bottom side of the cut sheet passing through the drying unit 8 to dry the side on which ink is applied. The drying method is not limited to applying hot air, but may instead irradiate the sheet surface with electromagnetic waves (ultraviolet rays or infrared rays).

The sheet conveying path, from the above-described sheet supplying unit 1 to drying unit 8, is referred to as "first path." The first path is bent in a U-shape from the printing unit 4 to the drying unit 8, and the cutting unit 6 is positioned at the bottom of the U-shape.

The reversing unit 9 reverses the sides of the continuous sheet to perform double-side printing by temporarily winding up the continuous sheet after printing is carried out on the front side. The reversing unit 9 is disposed midway of a path (loop path) (also referred to as "second path") from the drying unit 8 to the printing unit 4 via the decurling unit 2 for supplying the sheet that has passed through the drying unit 8 to the printing unit 4 again. The reversing unit 9 includes a winding rotary body that rotates to wind up the sheet. The continuous sheet, which is not cut yet but has received printing on the front side, is temporarily wound up by the winding rotary body. Once winding is completed, the winding rotary body is rotated in the reverse direction to feed the wound-up sheet in a reverse sequence to the decurling unit 2 and then to the printing unit 4. Since the front and back sides of the sheet are reversed, printing can be carried out on the back side of the sheet at the printing unit 4. A detailed operation of double-side printing is provided below.

The conveying unit 10 conveys the sheet cut at the cutting unit 6 and dried at the drying unit 8 to the sorting unit 11. The conveying unit 10 is disposed in a path (referred to as "third path"), which is different from the second path in which the reversing unit 9 is disposed. A path switching mechanism including a movable flapper for selectively guiding the sheet that has been conveyed through the first path to the second or third path is disposed at the branching point of the path.

The sorting unit 11 and the ejecting unit 12 are disposed on a side of the sheet supplying unit 1 and at the end of the third path. The sorting unit 11 sorts the printed sheets by group, when required. The sorted sheets are ejected into the ejecting unit 12, which includes a plurality of trays. In this way, the third path passes below the sheet supplying unit 1 and ejects to a side of the sheet supplying unit 1, which is opposite to the side on which the printing unit 4 and the drying unit 8 are disposed.

As described above, the units from the sheet supplying unit 1 to the drying unit 8 are disposed in order along the first path. Further down the drying unit 8, the path branches into the second path and the third path. The reversing unit 9 is disposed midway of the second path, and further down the reversing unit 9, the second path merges to the first path. The ejecting unit 12 is disposed at the end of the third path.

The control unit 13 controls all units in the printing apparatus. The control unit 13 includes a central processing unit (CPU), a storage device, a controller including various control units, an external interface, and an operating unit 15, which is operated by a user for input and output. The operation of the printing apparatus is controlled based on instructions from a host device 16, such as a host computer, which is connected via the controller or the external interface connected to the controller.

A mark reader 18 is disposed between the skew correcting unit 3 and the printing unit 4. The mark reader 18 is a reflective optical sensor that optically reads, from the side opposite to that on which printing is carried out, reference marks printed on the first side of the sheets conveyed from the reversing unit 9. The mark reader 18 includes a light source (for example, white LED) that illuminates the sheet surface and a light detector, such as a photodiode or an image sensor, which detects the RGB components of light from the illuminated sheet surface. The reference marks can be read through a change in the signal level of the light detector or image analysis of image acquisition data.

Figure 2:
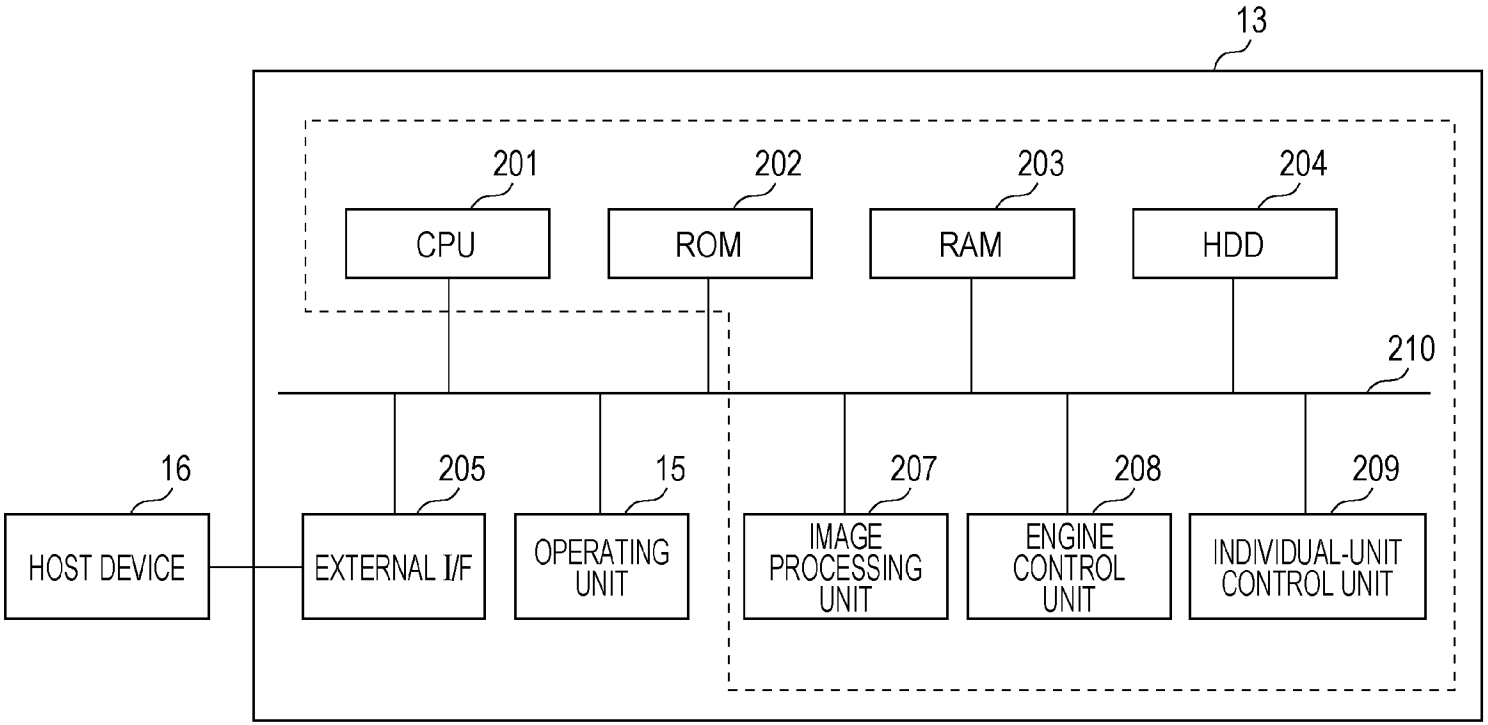
FIG. 2 is a block diagram of a control unit.

FIG. 2 is a block diagram illustrating the concept of the control unit 13. The controller in the control unit 13 (which is defined by the dotted line) includes a CPU 201, a ROM 202, a RAM 203, a hard disc drive (HDD) 204, an image processing unit 207, an engine control unit 208, and an individual-unit control unit 209. The CPU 201 controls the operation of the units in the printing apparatus. The ROM 202 holds programs executed by the CPU 201 and fixed data required for the various operations of the printing apparatus. The RAM 203 is used as a work area for the CPU 201, is used as temporary storage of various types of received data, and is used to hold various types of setting data. Programs executed by the CPU 201, printing data, and setting information required for various operations of the printing apparatus can be stored in and read out from the HDD 204. The operating unit 15 is an input/output interface for the user and includes an input unit, such as hard keys and/or a touch panel, and an output unit, such as a display and/or an audio generator for providing information.

For units that require high-speed processing, individual processors are provided. The image processing unit 207 carries out image processing of printing data handled by the printing apparatus. The color space (for example, YCbCr) of the input image data is converted to a standard RGB color space (for example, sRGB). Various types of image processing, such as resolution conversion, image analysis, image correction, etc., are carried out on the image data, if required. The printing data acquired through such image processing is stored in the RAM 203 or the HDD 204. The engine control unit 208 carries out drive control of the print head 14 of the printing unit 4 in accordance with the printing data based on the control commands received from the CPU 201, etc. The engine control unit 208 also controls the conveying mechanisms of the units in the printing apparatus. The individual-unit control unit 209 is a sub-controller for individually controlling the sheet supplying unit 1, the decurling unit 2, the skew correcting unit 3, the detecting unit 5, the cutting unit 6, the information recording unit 7, the drying unit 8, the reversing unit 9, the conveying unit 10, the sorting unit 11, and the ejecting unit 12. The operations of the units are controlled by the individual-unit control unit 209 based on the commands from the CPU 201. The external interface (I/F) 205 connects the controller to the host device 16 and is a local I/F or a network I/F. The above-described components are connected via a system bus 210.

The host device 16 is a supply source of image data to be printed by the printing apparatus. The host device 16 may be a general-use or specialized computer, or may be a special image device, such as an image capturer having an image reader, a digital camera, or a photo-storage. When the host device 16 is a computer, the operating system (OS), application software for generating image data, and printer driver for the printing apparatus are installed in the storage device in the computer. Each sequence of the above-described processing does not necessarily have to be achieved by software, but part or all of sequences may be achieved by hardware.

The basic printing operation will be described below. Since the operations of printing in the single-side printing mode and the double-side printing mode differ, each mode will be described separately.

Figure 3A:
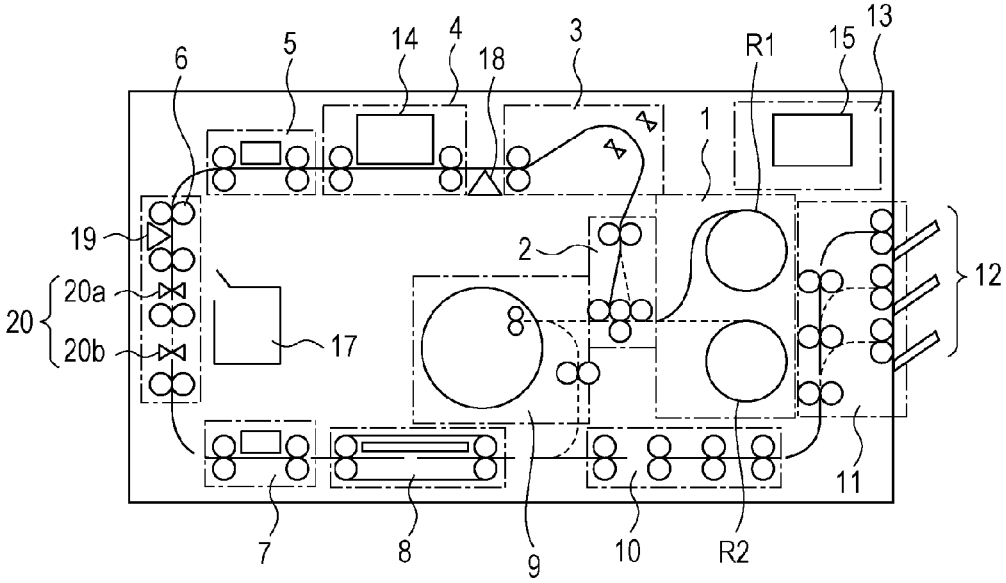
FIGS. 3A and 3B illustrate the operation in a single-side printing mode and a double-side printing mode.

FIG. 3A illustrates the operation in the single-side printing mode. Printing is carried out at the printing unit 4 on the front side (first side) of the sheet supplied from the sheet supplying unit 1 and processed at the decurling unit 2 and the skew correcting unit 3. Images (unit images) having a predetermined unit length in the conveying direction are printed in sequence on the long continuous sheet to form an array of images. A blank is provided between two consecutive images, and the printing unit 4 prints a cutting mark in the blank. The printed sheet is conveyed through the detecting unit 5 and, at the cutting unit 6, is cut into unit images by the cutters 20 based on the cutting marks detected by the cutting-mark sensor 19. If required, printing information is printed on the back side of each cut sheet at the information recording unit 7. Each cut sheet is conveyed to the drying unit 8, where it is dried. Then, the cut sheets are conveyed through the conveying unit 10 and sequentially ejected into the ejecting unit 12 of the sorting unit 11, where they are stacked. The continuous sheet that is left on the side of the printing unit 4 after the last unit image is cut off is sent back to the sheet supplying unit 1, where it is wound on to the roll R1 or R2.

As described, in single-side printing, the sheet is conveyed through and processed in the first and third paths and is not conveyed through the second path. In summary, in the single-printing mode, the following sequence (1) to (6) is carried out under control of the control unit 13:

(1) the sheet is fed to the printing unit 4 from the sheet supplying unit 1;

(2) unit images and cutting marks are repeatedly printed on the first side of the supplied sheet at the printing unit 4;

(3) the sheet is cut at the cutting unit 6 into unit images printed on the first side;

(4) each cut sheet with a unit image is conveyed through the drying unit 8;

(5) each sheet conveyed through the drying unit 8 is conveyed through the third path and is ejected to the ejecting unit 12; and (6) the continuous sheet remaining on the side of the printing unit 4 after the last unit image is cut of is sent back to the sheet supplying unit 1.

Figure 3B:
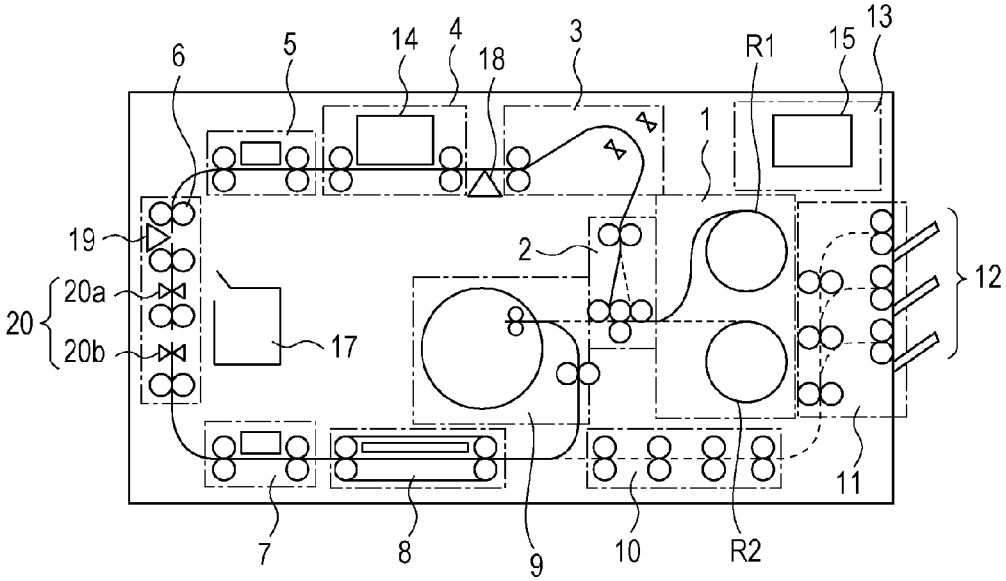

FIG. 3B illustrates the operation in the double-side printing mode. In double-side printing, subsequent to the front side (first side) printing sequence, the back side (second side) printing sequence is carried out. In the front-side printing sequence, the operation of the units from the sheet supplying unit 1 to the detecting unit 5 is the same as the operation in the above-described single-side printing. At the cutting unit 6, the sheet is not cut, and the continuous sheet is directly conveyed to the drying unit 8. After the ink on the front side is dried at the drying unit 8, the sheet is guided to the path on the side of the reversing unit 9 (second path), instead of to the path on the side of the conveying unit 10 (third path). In the second path, the sheet is wound up by the winding rotary body of the reversing unit 9 in the forward direction (counterclockwise in the drawing). Upon completion of the programmed printing on the front side at the printing unit 4, the following edge of the printing area on the continuous sheet is cut at the cutting unit 6. Based on the cut position, the continuous sheet downstream of the conveying direction (printed side) is conveyed through the drying unit 8 and is completely wound up to the following edge of the sheet (cut position) at the reversing unit 9.

Simultaneously to the winding, the continuous sheet upstream of the conveying direction (printing unit 4 side) from the cutting position is rewound by the sheet supplying unit 1 onto the roll R1 or R2 so that the leading edge (cutting position) of the sheet does not remain in the decurling unit 2. Through such rewinding, the sheet is prevented from colliding with a sheet supplied in the following back-side printing sequence.

Upon completion of the above-described front-side printing the sequence is switched to back-side printing. The winding rotary body in the reversing unit 9 rotates in a direction opposite to that during winding (clockwise in the drawing). The edge of the wound-up sheet (following edge of the sheet during wind-up is the leading edge during feeding) is fed to the decurling unit 2 along the path indicated by the dotted lines in the drawing. The curling of the sheet caused by the winding rotary body is corrected at the decurling unit 2. That is, the decurling unit 2 is disposed between the sheet supplying unit 1 and the printing unit 4 in the first path and between the reversing unit 9 and the printing unit 4 in the second path, i.e., is shared by both paths. The sheet of which the front and back sides have been reversed is conveyed through the skew correcting unit 3 and to the printing unit 4, where printing of the unit images and cutting marks is carried out on the back side of the sheet. The printed sheet is conveyed through the detecting unit 5 and is cut at the cutting unit 6 by each predetermined unit length set in advance. Since printing is applied to both sides of the cut sheets, printing information is not carried out at the information recording unit 7. Each cut sheet is conveyed to the drying unit 8, conveyed through the conveying unit 10, and sequentially ejected into the ejecting unit 12 of the sorting unit 11, where the sheets are stacked.

In double-side printing, the sheet is conveyed through the first path, the second path, the first path, and the third path, in this order. In summary, in the double-printing mode, the following sequence (1) to (11) is carried out under control of the control unit 13:

(1) the sheet is fed to the printing unit 4 from the sheet supplying unit 1;

(2) unit images are repeatedly printed on the first side of the supplied sheet at the printing unit 4;

(3) the sheet on which printing has been carried out on the first side is conveyed through the drying unit 8;

(4) the sheet conveyed through the drying unit 8 is guided to the second path and is wound up by the winding rotary body in the reversing unit 9;

(5) the sheet is cut downstream of the last-printed unit image at the cutting unit 6 after repeated printing to the first side is completed;

(6) the cut sheet is wound up by the winding rotary body until the edge of the sheet is conveyed through the drying unit 8 and reaches the winding rotary body, and simultaneously, the sheet remaining on the printing unit 4 side after the cutting is sent back to the sheet supplying unit 1;

(7) once the winding is completed, the winding rotary body is rotated in the reverse direction to supply the sheet again to the printing unit 4 through the second path;

(8) unit images and cutting marks are repeatedly printed on the second side of the sheet supplied through the second path at the printing unit 4;

(9) the sheet is repeatedly cut at the cutting unit 6 into separate unit images printed on the second side;

(10) each cut sheet with a unit image is conveyed through the drying unit 8; and

(11) each sheet that has been conveyed through the drying unit 8 is conveyed through the third path and is ejected into the ejecting unit 12.

The operation of cutting the sheet into unit images will be described in detail below. As described above, in the single-side printing mode or in the back-side printing sequence in the double-side printing mode, the sheet is cut into unit images.

Figure 4A:
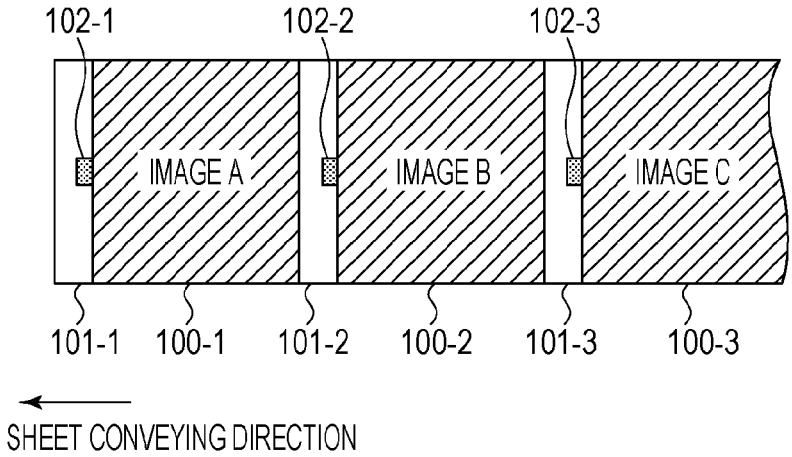
FIGS. 4A to 4C illustrate arrays of unit images printed in sequence on a sheet.
Figure 4B:
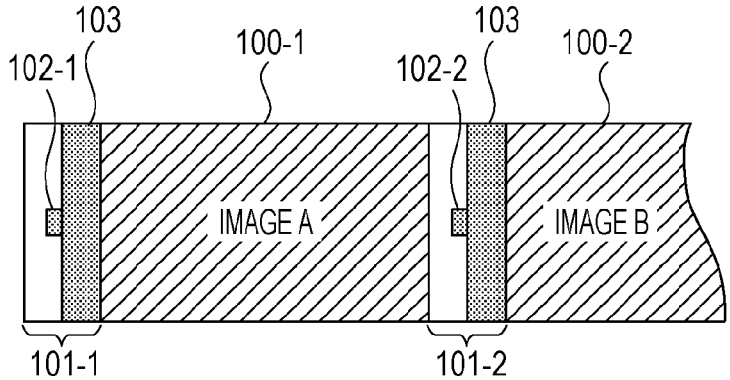
Figure 4C:
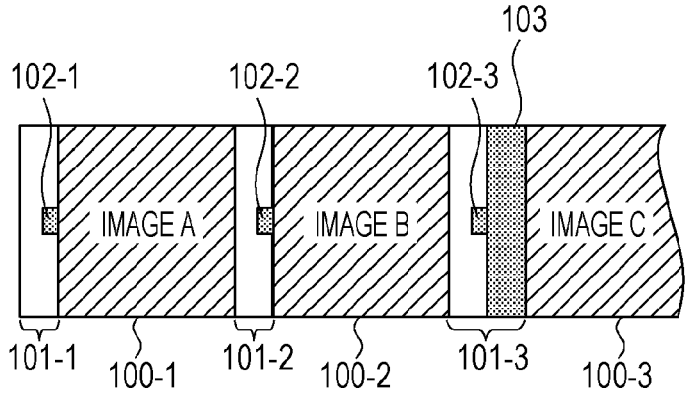

FIGS. 4A to 4C illustrate that an array of unit images (image A, image B, image C, . . . ) is printed on the sheet. In the example illustrated in FIG. 4A, image regions (100-1, 100-2, 100-3, . . . ) and non-image regions (101-1, 101-2, 101-3, . . . ) are alternately arranged. Cutting marks (102-1, 102-2, 102-3, . . . ), which serve as references for cutting the sheet, are provided in the non-image regions. That is, reference marks for cutting the sheet are provided in the regions between adjacent unit images (such adjacent unit images are referred to as first and second images in this document). In the example illustrated in FIG. 4B, maintenance patterns 103 for print head maintenance (mis-discharge inspection, etc.) are provided together with the cutting mars marks 102 in the non-image regions (101-1, 101-2, 101-3, . . . ) between adjacent unit images. In this example, the length of the unit images (image A, image B, . . . ) in the conveying direction is larger than that in FIG. 4A. In the example in FIG. 4C, the maintenance patterns 103 are provided in only some of the non-image regions. As a result, the lengths of the non-image regions in the conveying direction are not the same. In the examples described above, for simplification, the length of the unit images (image A, image B, . . . ) in the conveying direction are illustrated as being the same, but in practice, the images are typically various different sizes.

Figure 5A:
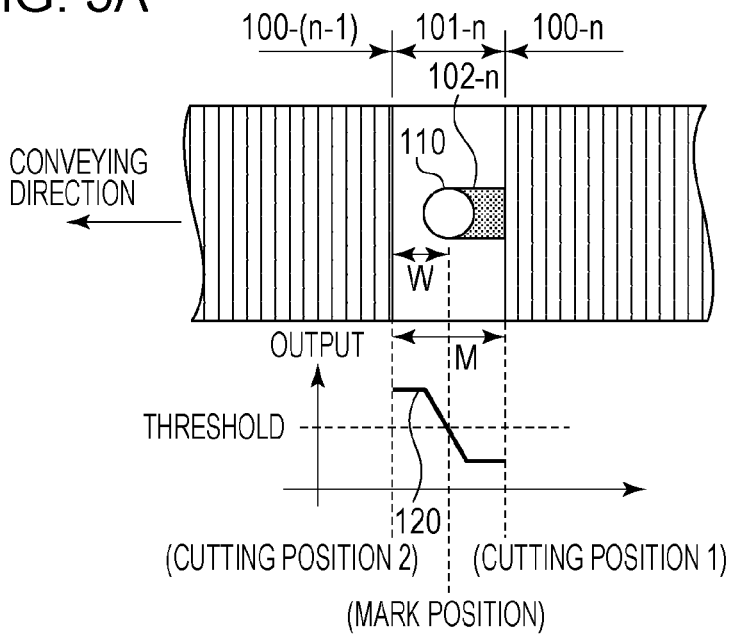
FIGS. 5A and 5B illustrate the principle of cutting mark detection.

FIG. 5A illustrates the principle of detecting cutting marks with the cutting-mark sensor 19 (mark detecting unit). The cutting-mark sensor 19 is a small optical sensor having a light source and a light detector. Spot light 110 with a predetermined size from the light source is incident on the sheet. A rectangular cutting mark 102-*n* is printed on the sheet with ink. A small semiconductor light source (LED, OLED, semiconductor laser, etc.) can be suitably used as the light source. For example, if a red LED is used as the light source, black ink, which has a high light absorption distribution characteristic for red, is used to form the cutting mark 102-*n*. The print head 14 of the printing unit 4 can be used to form the cutting marks. However, a special marking unit may be provided, separate from the printing unit 4, to print the cutting marks, which serve as references for cutting the sheet. In such a case, instead of printing the marks with ink with the special marking unit, small holes may be formed in the sheet as marks. Since holes do not reflect light (i.e., have zero reflectance), they function in the same way as black ink, allowing them to be detected as cutting marks by an optical sensor in a manner similar to or the same as that described above.

The non-image regions 101-*n* has a length M in the conveying direction. As illustrated in FIGS. 4B and 4C, in case the maintenance patterns 103 are provided, the non-image regions 101-*n* include the maintenance patterns 103, and thus the length thereof is larger than M. A blank, which is an area where ink is not applied and has a length W in the conveying direction, is provided between the cutting mark 102-*n* and an image region 100-($n$−1) (first image), which is one of two adjacent unit images. Hereinafter, this blank is referred to as a first sub-region, and the cutting mark 102-*n* is referred to as a second sub-region. By providing the first sub-region, which is the blank, between the first image and the second sub-region, the first image and the cutting mark 102-*n* can be easily distinguished. As described below, the lengths M and W are not constant and may vary.

The graph in the bottom section of FIG. 5A illustrates a change in an output signal of the light detector of the cutting-mark sensor 19. As the sheet is conveyed, the non-image region 101 passes through the spot light (detection position) from the light source. At this time, as illustrated in graph 120, the signal level of the detected output suddenly changes from high (white area with high reflectance) to low (black area with low reflectance). The degree of change (slope of the graph) is determined by the diameter of the spot light 110. The position corresponding to the moment the changing signal level falls below a predetermined threshold is detected as a mark. Based on the detected cutting mark, two positions preceding and following the cutting mark are set as cutting positions (cutting position 1 and cutting position 2 on the sheet) where the sheet is cut. In the conveying direction, the distance between the cutting position 1 and the cutting position 2 is greater than or equal to M, which is the length of the non-image region 101.

Figure 5B:
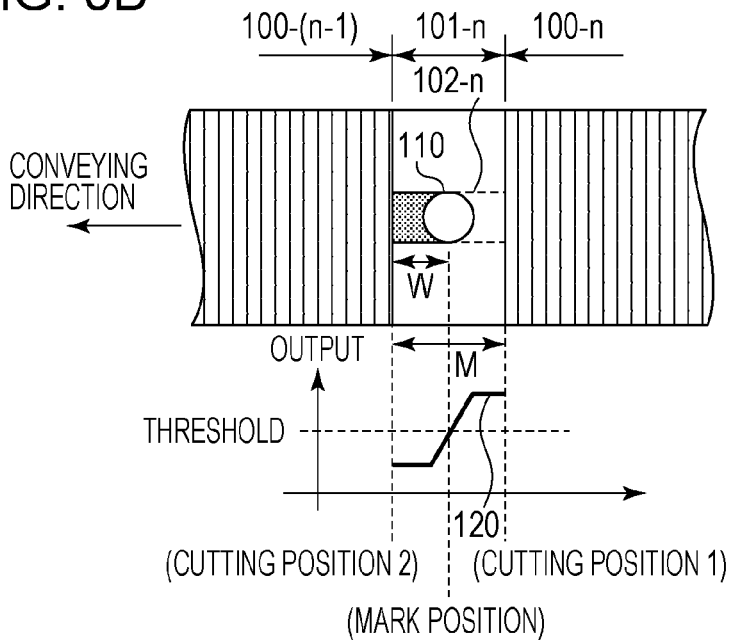
Figure 6:
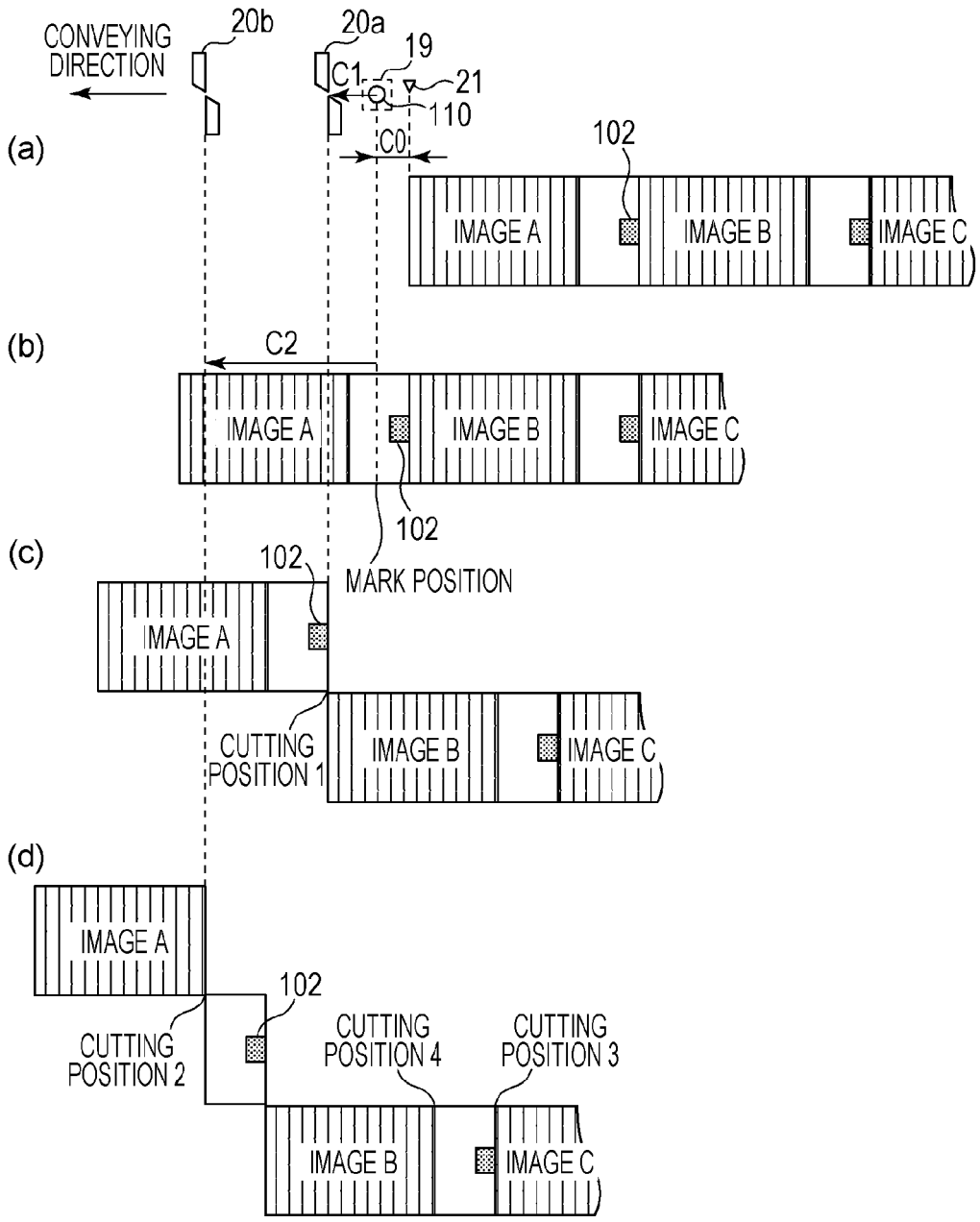
FIGS. 6A to 6D illustrate the operation of sheet cutting.

FIG. 5B illustrates a modification of cutting mark formation. By forming a cutting mark with black ink in the first sub-region and forming a blank in the second sub-region, the signal level of the detected output suddenly changes from low (black area with low reflectance) to high (white area with high reflectance), which is opposite to the above. That is, one of the first and second sub-regions may be black in which ink in applied and the other sub-region may be white (blank) in which ink is not applied. Since a change in the signal level is caused by the contrast of the first and second sub-regions, one of the sub-regions may be gray, instead of being black or white (blank). Instead of distinguishing the first and second sub-regions by concentration, they may be distinguished by color, reflectance, etc. That is, the cutting mark may be formed in the non-image region in the conveying direction such that a first sub-region and a second sub-region, which has a concentration, color, or reflectance different from that of the first sub-region, are adjacent to each other. The cutting mark can be detected by detecting a change in the output values of the light detector when the first and second sub-regions sequentially pass the position on which the spot light is incident. Here, "reflectance" also applies to a case in which a hole is formed in a sheet to serve as a cutting mark, as described above. Since light does not reflect at the hole, the reflectance is substantially zero, which differs from the reflectance of the area other than the hole. Therefore, the hole can be optically identified as a cutting mark.

The cutting marks are not constantly detected by the cutting-mark sensor 19 during printing, but are detected during periods in which the center of the first sub-regions on the sheet is estimated to pass by the detection position of the cutting-mark sensor 19. That is, the cutting-mark sensor 19 does not detect the cutting marks during periods in which image regions are estimated to pass the detection position and skips the images. Such estimation is based on a calculation associated with the lengths of the image regions 100-*n* and non-image regions 101-*n*. In this way, the cutting-mark sensor 19 is prevented from mistakenly detecting patterns in the image regions as cutting marks.

FIGS. 6A to 6D illustrates the operation of sheet cutting. The edge sensor 21, which detects the edge of the sheet, is disposed upstream and near the detection position of the cutting-mark sensor 19. The edge of the sheet being conveyed is detected by the edge sensor 21 (see FIG. 6A). Beginning at the detected edge, cutting mark detection is skipped for a predetermined amount of time or a predetermined distance. Cutting mark detection is skipped for at least the period in which the sheet is conveyed for at least a distance equivalent to the length of the image A in the conveying direction.

After skipping, cutting mark detection is resumed by the cutting-mark sensor 19. The cutting mark 102 on the sheet being conveyed is detected at the cutting-mark sensor 19 (see FIG. 6B). Base on this detection, the cutting position 1, where the sheet is cut by the first cutter 20*a*, and the cutting position 2, where the sheet is cut by the second cuter 20*b*, are set upstream and downstream of the cutting-mark sensor 19. When the cutting position 1 reaches the first cutter 20*a*, the conveying of the sheet is locally temporarily stopped. The conveying of the sheet is only stopped at the cutting unit 6, thus, the sheet conveyed from upstream while the conveying is stopped at the cutting unit 6 slacks and is accumulated in a buffer disposed between the detecting unit 5 and the cutting unit 6, preventing the conveying of the sheet at the printing unit 4 from being stopped. The sheet that has been stopped is cut with the first cutter 20*a* at the cutting position 1. By this cutting, the sheet is separated into a cut sheet, which contains the image A and the subsequent non-image region, and the continuous sheet containing the image B and the subsequent images (see FIG. 6C).

Upon finishing cutting, the cut sheet is conveyed. When the downstream cutting position 2 reaches the second cutter 20*b*, the conveying of the sheet is locally temporarily stopped. Then, the sheet is cut with the second cutter 20*b* at the cutting position 2. By this cutting, the non-image region of the cut sheet is cut off, and only the image remains (see FIG. 6D). The cut-off non-image region is discarded to the waste box 17 as a sheet fragment.

Subsequently, the conveying of the cut sheet corresponding to the image A and the subsequent continuous sheet is resumed, and the cutting of images B, C, and so on are repeated as described above. In the present embodiment, the operation of the first cuter 20*a* and the second cutter 20*b* are controlled based on the detection signals from the cutting-mark sensor 19. In another embodiment, individual cutting-mark sensors may be provided for the first cuter 20*a* and the second cutter 20*b*.

Figure 7:
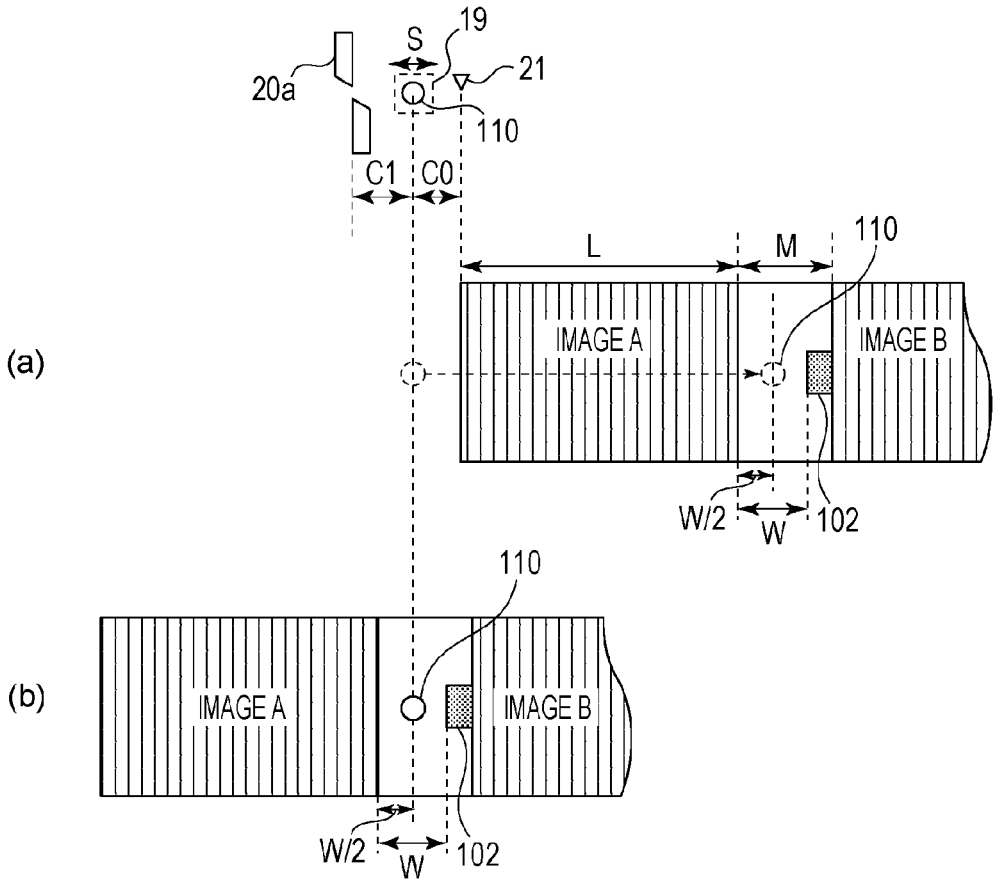
FIGS. 7A and 7B illustrate skipping in cutting mark detection.

FIG. 7 illustrates the skipping of cutting mark detection. Upon detection of the sheet edge (edge of the image A) by the edge sensor 21, cutting mark detection in the region corresponding to the image A is skipped. The distance to be skipped can be determined based on the distances among the edge sensor 21, the cutting-mark sensor 19, the first cutter 20*a*, the length L of the image A, the length W of the first sub-region, the length M of the non-image region, and the diameter S of the spot light emitted from the cutting-mark sensor 19.

$C_0$ represents the distance from the detection position of the edge sensor 21 to the detection position (center of spot light) of the cutting-mark sensor 19, and $C_1$ represents the distance from the detection position (center of spot light) of the cutting-mark sensor 19 to the cutting position of the first cutter 20*a*. The length of the cutting mark 102 in the conveying direction (i.e., length of the second sub-region) is represented by M−W. Since the diameter S of the spot light does not have to be larger than the cutting mark, it can be represented as M−W=S. The distance the sheet is conveyed from the point the sheet is detected at the edge sensor 21 to the point where cutting mark detection is started is represented as $C_0$+L+W/2, if the detection starting position is set at the center of the first sub-region (=W/2). This is the distance to be skipped. The position where detection is started after the skipping is a position W/2 downstream from the following edge of the image A. The range of which detection is to be continued after starting the cutting mark detection is set to W/2+S, which is a range that allows sufficient cutting mark detection from the starting position of the cutting mark detection. Setting the detection starting position to the center of the first sub-region (=W/2) is merely an example, and the starting position may be set to any other position within the first sub-region. Setting the detection range to W/2+S is also merely an example, and any range is allowed so long as at least the second sub-region is covered.

While the lengths have a relationship as described above, it is useful to provide a margin for various error components, such as conveying amount error, image size error, assembly error of various components, and detection error of sensor. If such errors are not considered, accurate cutting mark detection may not be possible due to displacement of the starting position of cutting mark detection and the actual position of the cutting marks on the conveyed sheet. Accordingly, the distance to be skipped for detection is set to a distance that corresponds to the above-described theoretical distance plus various errors.

Among the various errors, the conveying amount error and the image size error may increase or decrease in response to the lengths of the images that are printed in the conveying direction. The longer the image is, the larger the error becomes. Thus, the width W of the first sub-region in the non-image region is changed in accordance with the length of the previous image (first image). When the length L of the first image is large, the width W of the first sub-region is set large to increase the margin for absorbing the errors. In response to the change in the width W, the starting position of cutting mark detection (downstream by W/2 from the following edge of the image A) and the detection range (W/2+S) also changes.

As a margin for absorbing the errors, a correction value H is added to the theoretical standard width W of the first sub-region in accordance with the length L of the previous image A. The correction value H can be represented as $H=\alpha+\beta$, where $\alpha$ represents an error component that varies in response to the image size, and $\beta$ represents an error component of each individual apparatus that does not depend on the image size. Since the error component $\alpha$ can be represented as $L\times K$, where L represents the length of the image A and K represents a coefficient, the correction value H can be represented as $H=L\times K+\beta$.

Figure 8:
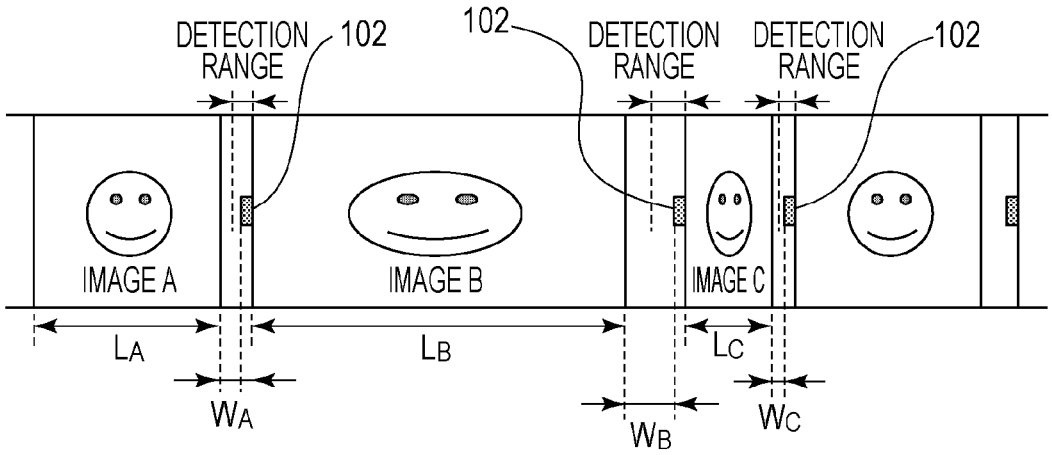
FIG. 8 illustrates a printing example in which images of various sizes are printed.

FIG. 8 illustrates an example of printing when images of various sizes are printed. In the conveying direction, the relationship among the length $L_A$ of the image A, the length $L_B$ of the image B, and the length $L_C$ of the image C is $L_B>L_A>L_C$. The images A, B, and C are unit images. Images with partial or total blanks may be printed, or images smaller than the image region may be printed together with margins therearound. The relationship of the width $W_A$ of the first sub-region in the non-image region following the image A, the width $W_B$ of the first sub-region in the non-image region following the image B, and the width $W_C$ of the first sub-region in the non-image region following the image C is $W_B>W_A>W_C$. Thus, the distance from the edge of the previous image to the starting position of cutting mark detection becomes larger in the following order: the image C, the image A, and the image B. Furthermore, the detection ranges of cutting mark detection also become larger in the following order: the image C, the image A, and the image B.

The first images may be grouped into different sizes, and non-image regions having corresponding sizes may be assigned to these groups. A large non-image region is assigned to the large-size group. In such a case, non-image regions of the same size are assigned to images in the same group, having different sizes.

As described above, even if the error components increase as the image size increases, a large margin is provided to compensate for this. Thus, reliable cutting mark detection is achieved, regardless of the image size. From a different viewpoint, since the margin can be set small when the image is small, the number of images that can be printed on a roll of continuous sheet increases. In other words, the amount of sheet fragments, which are discarded, can be decreased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-020142 Feb. 1, 2011, which is hereby incorporated by reference herein in its entirety.

What is claimed is:

1. A method of printing comprising:

printing a first image on a sheet being conveyed;

forming a reference mark for cutting the sheet in a non-image region between the first image and a second image following the first image;

printing the second image on the sheet being conveyed;

detecting the reference mark; and cutting the sheet to cut off the non-image region by using a first cutter and a second cutter provided downstream of the first cutter based on the detected reference mark, wherein the reference mark is formed with a length in a conveying direction of the sheet in accordance with a length of the first image in the conveying direction, and the second image is printed to set a length of the non-image region in the conveying direction in accordance with the length of the first image in the conveying direction, and when cutting off the non-image region, the first cutter first cuts off a downstream side of the second image, and then the second cutter cuts off an upstream side of the first image after conveying a cut sheet portion including the first image and the non-image region for a distance determined according to a length of the non-image region.

2. The method of printing according to claim 1, further comprising:

setting a starting position where detection of the reference mark is started inside the non-image region in accordance with the length of the first image.

3. The method of printing according to claim 2, further comprising: setting the starting position and a detection range for detecting the reference mark from the starting position in accordance with the length of the first image.

4. The method of printing according to claim 1, wherein the reference mark is detected by irradiating the sheet with spot light from a light source, receiving the light reflected at the sheet by a light detector, and comparing an output value of the light detector with a threshold.

5. The method of printing according to claim 4, wherein, the reference mark includes a first sub-region and a second sub-region adjacent to each other in the region along the conveying direction, the second sub-region having a concentration, color, or reflectance different from a concentration, color, or reflectance of the first sub-region, and wherein the reference mark is detected by detecting a change in the output value when the first sub-region and the second sub-region sequentially pass a position irradiated with the spot light.

6. The method of printing according to claim 5, wherein as the length of the first image in the conveying direction increases, the length of the first sub-region in the conveying direction increases.

7. The method of printing according to claim 6, wherein the length of the second sub-region in the conveying direction is set constant and independently from the length of the first image.

8. The method of printing according to claim 5, wherein ink is applied to one of the first sub-region and the second sub-region, and wherein whichever sub-region ink is not applied to is blank.

9. The method of printing according to claim 1, wherein the length of the first image in the conveying direction differs from the length of the second image in the conveying direction.

10. The method of printing according to claim 1, wherein, a plurality of images is printed in sequence on a first side of a continuous sheet, a plurality of images is printed in sequence on a second side of the sheet, and the reference mark is printed when images are printed on the second side to cut the sheet into separate images.

11. A printing apparatus comprising:

a printing unit configured to print images on a sheet being conveyed;

a detection unit configured to detect a reference mark for cutting the sheet;

a cutter unit having a first cutter and a second cutter provided downstream of the first cutter, configured to cut the sheet based on the detected reference mark; and a control unit configured to control the printing unit to print a first image and a second image following the first image, wherein the reference mark is provided in a non-image region between the first image and the second image, wherein the reference mark has a length in a conveying direction of the sheet set in accordance with a length of the first image in the conveying direction, and a length of the non-image region in the conveying direction is set in accordance with the length of the first image in the conveying direction, and when cutting off the non-image region, the first cutter cuts off a downstream side of the second image, and then the second cutter cuts off an upstream side of the first image after a cut sheet portion including the first image and the non-image region is conveyed for a distance determined according to a length of the non-image region.

12. A method of printing comprising:

printing an image in a first region of a sheet being conveyed;

forming a reference mark for cutting the sheet in a non-image region between the first region and a second region following the first region;

printing an image in the second region;

detecting the reference mark; and cutting the sheet to cut off the non-image region by using a first cutter and a second cutter provided downstream of the first cutter based on the detected reference mark, wherein the second region is set so as to set a length of the non-image region and a length of the reference mark in a conveying direction in which the sheet is conveyed in accordance with a length of the first region in the conveying direction, and when cutting off the non-image region, the first cutter first cuts off a downstream side of the second image, and the second cutter cuts off an upstream side of the first image after conveying a cut sheet portion including the first image and the non-image region for a distance determined according to the length of the non-image region.

13. The method of printing according to claim 12, further comprising: setting a starting position where detection of the reference mark is started inside the non-image region in accordance with the length of the first region.

14. The method of printing according to claim 13, further comprising: setting the starting position and a detection range for detecting the reference mark from the starting position in accordance with the length of the first region.

15. The method according to claim 12, wherein a detection range of the reference mark detection in the non-image region is set in accordance with the length of the first region in a conveying direction in which the sheet conveyed.

* * * * *